US005829347A

United States Patent [19]

Hiruma

[11] Patent Number: 5,829,347

[45] Date of Patent: Nov. 3, 1998

[54] ELECTROPRESSING APPARATUS

[75] Inventor: Kenichiro Hiruma, Tokyo, Japan

[73] Assignee: Janome Sewing Machine Co., Ltd., Tokyo, Japan

[21] Appl. No.: 858,342

[22] Filed: May 19, 1997

[30] Foreign Application Priority Data

May 21, 1996 [JP] Japan ..... 8-125681

[51] Int. Cl.[6] ..... B30B 15/14; B30B 15/26

[52] U.S. Cl. ..... 100/43; 100/50; 100/256; 100/289

[58] Field of Search ..... 100/43, 48, 50, 100/52, 53, 256, 289

[56] References Cited

U.S. PATENT DOCUMENTS

| | | | |
|---|---|---|---|
| 5,379,688 | 1/1995 | Ishii | 100/43 |
| 5,483,874 | 1/1996 | Shimizu et al. | 100/50 |

FOREIGN PATENT DOCUMENTS

| | | |
|---|---|---|
| 6-15494 | 1/1994 | Japan . |
| 6-15495 | 1/1994 | Japan . |
| 6-15496 | 1/1994 | Japan . |
| 6-15497 | 1/1994 | Japan . |
| 6-15498 | 1/1994 | Japan . |
| 6-218593 | 8/1994 | Japan . |
| 6-218594 | 8/1994 | Japan . |
| 6-218596 | 8/1994 | Japan . |
| 6-218597 | 8/1994 | Japan . |
| 7-116899 | 5/1995 | Japan . |

*Primary Examiner*—Stephen F. Gerrity
*Attorney, Agent, or Firm*—Lowe Hauptman Gopstein Gilman & Berner

[57] ABSTRACT

An electropressing apparatus has a pressing ram axially movable to apply a pressure to a workpiece to be pressed. The apparatus comprising an electric drive motor, a motor driver for driving the electric drive motor, a drive mechanism including a threaded drive shaft operatively connected to the electric drive motor to be rotated by thereby, a transmission device operatively connected to the threaded drive shaft and to the pressing ram to convert the rotational movement of the threaded drive shaft into the axial movement of the pressing ram, a first control for setting, memorizing and detecting an initial position of the pressing ram relative to the workpiece, a second control for setting, memorizing, detecting and changing a press starting position of the pressing ram relative to the workpiece, a third control for setting, memorizing, detecting and changing a pressure of the pressing ram to be applied to the workpiece and a fourth control for setting, memorizing, detecting and changing a period of time of the pressing ram for pressing the workpiece with a set pressure, wherein the period of time of the pressing ram for pressing the workpiece with a set pressure starts to be counted at a time when a set pressure is detected.

3 Claims, 7 Drawing Sheets

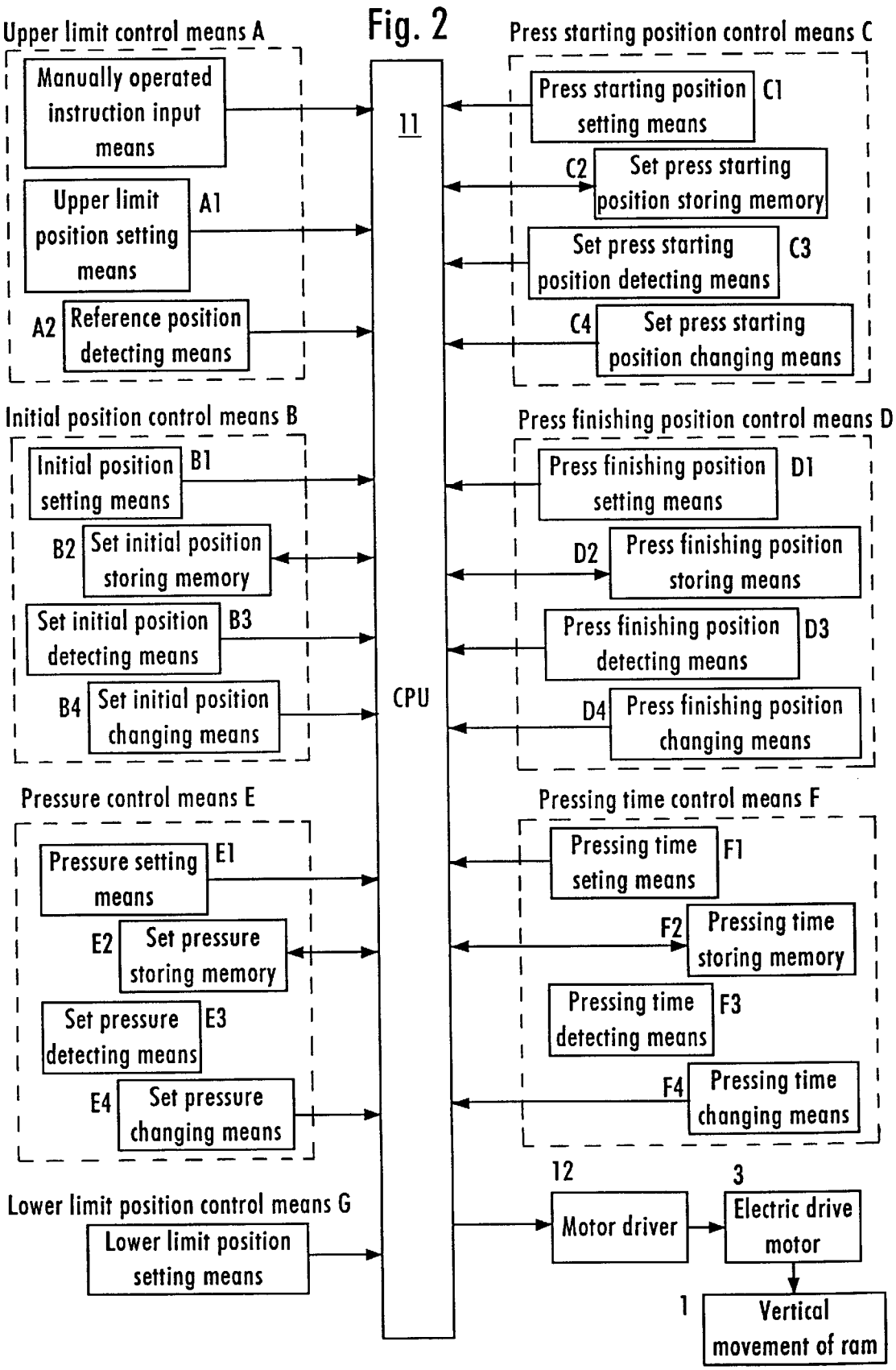
Fig. 2
Upper limit control means A
Manually operated instruction input means
Upper limit position setting means
A1
A2
Reference position detecting means
Initial position control means B
Initial position setting means
B1
B2
Set initial position storing memory
Set initial position detecting means
B3
B4
Set initial position changing means
Pressure control means E
Pressure setting means
E1
E2
Set pressure storing memory
Set pressure detecting means
E3
E4
Set pressure changing means
Lower limit position control means G
Lower limit position setting means
11
CPU
Press starting position control means C
Press starting position setting means
C1
C2
Set press starting position storing memory
Set press starting position detecting means
C3
C4
Set press starting position changing means
Press finishing position control means D
Press finishing position setting means
D1
D2
Press finishing position storing means
Press finishing position detecting means
D3
D4
Press finishing position changing means
Pressing time control means F
Pressing time seting means
F1
F2
Pressing time storing memory
Pressing time detecting means
F3
F4
Pressing time changing means
12
Motor driver
3
Electric drive motor
1
Vertical movement of ram

ELECTROPRESSING APPARATUS

BACKGROUND OF THE INVENTION

The invention relates to an electropressing apparatus, and more particularly relates to an electropressing apparatus which is capable of pressing powders into solid matters and/or pressing semi-solid matters into cases, which are all small products.

The electropressing apparatus for pressing workpieces precisely and effectively has been already proposed in the same applicants Japanese patent application laid open Hei 6 (1994)-15494. This electropressing apparatus substantially comprises an electric drive motor, a motor driver for driving the motor, a drive mechanism including a threaded drive shaft operatively connected to the motor to be rotated thereby, transmission means operatively connected to the threaded drive shaft and to the pressing ram of the apparatus to convert the rotational movement of the threaded drive shaft into the axial movement of the pressing ram, a first control means for controlling an initial position of the pressing ram, a second control means for setting, memorizing, detecting and changing a press starting position of the pressing ram and a third control means for setting, memorizing, detecting and changing an amount of pressure to be applied to a workpiece to be pressed.

This electropressing apparatus has been received in the market with a reputation. As the specific property of the apparatus has been understood, the market has come to require a wider range of usage of the apparatus, especially to press powders into solid matters and/or press semi-solid matters into cases with a required amount of pressure for a predetermined period of time.

SUMMARY OF THE INVENTION

It is therefore a primary object of the invention to provide an electropressing apparatus which is especially adapted to press powders into solid matters and/or press semi-solid matters into cases.

It is another object of the invention to provide an electropressing apparatus which is structurally compact and functionally reliable for pressing required workpieces.

It is still another object of the invention to provide an electropressing apparatus including a vertically moving pressing ram, the vertical position of which is controlled with required speeds, pressures and periods of time each designated by a central processing unit (CPU).

The invention satisfies the foregoing objects and eliminates the defects and disadvantages of the prior art through an electropressing apparatus which is structurally compact and rapidly operable with both high precision and efficiency to press workpieces including powders and semi-solid matters. In the apparatus of the invention, an electric drive motor rotates a threaded drive shaft that drives a pressing ram in a vertical direction, the vertical directions of which are controlled with required speeds and pressures each designated by a central processing unit (CPU) with respect to workpieces to be pressed.

An electropressing apparatus has a pressing ram movable in vertical directions to apply a pressure to a workpiece to be pressed, the apparatus comprising an electric drive motor, a motor driver for driving the electric drive motor, a drive mechanism including a threaded drive shaft operatively connected to the electric drive motor to be rotated thereby, transmission means operatively connected to the threaded dive shaft and to the pressing ram to convert the rotational movement of the threaded drive shaft into the axial and vertical movement of the pressing ram, a first control means for setting, memorizing and detecting an initial position of the pressing ram relative to the workpiece, a second control means for setting, memorizing, detecting and changing a press starting position of the pressing ram relative to the workpiece, a third control means for setting, memorizing, detecting and changing a pressure of the pressing ram to be applied to the workpiece and a fourth control means for setting, memorizing, detecting and changing a period of time for pressing the workpiece with a set pressure, wherein the pressing period of time starts to be counted at a time when a set pressure is detected and wherein the press starting position, the pressure of the pressing ram and the pressing period of time may be optionally controlled in plural steps respectively by optionally inputting control values depending upon a type of workpiece to be pressed.

BRIEF DESCRIPTION OF THE DRAWINGS

FIG. 2 is a detailed block diagram of the control system of FIG. 1;

DETAILED DESCRIPTION OF THE EMBODIMENT

Figure 7:
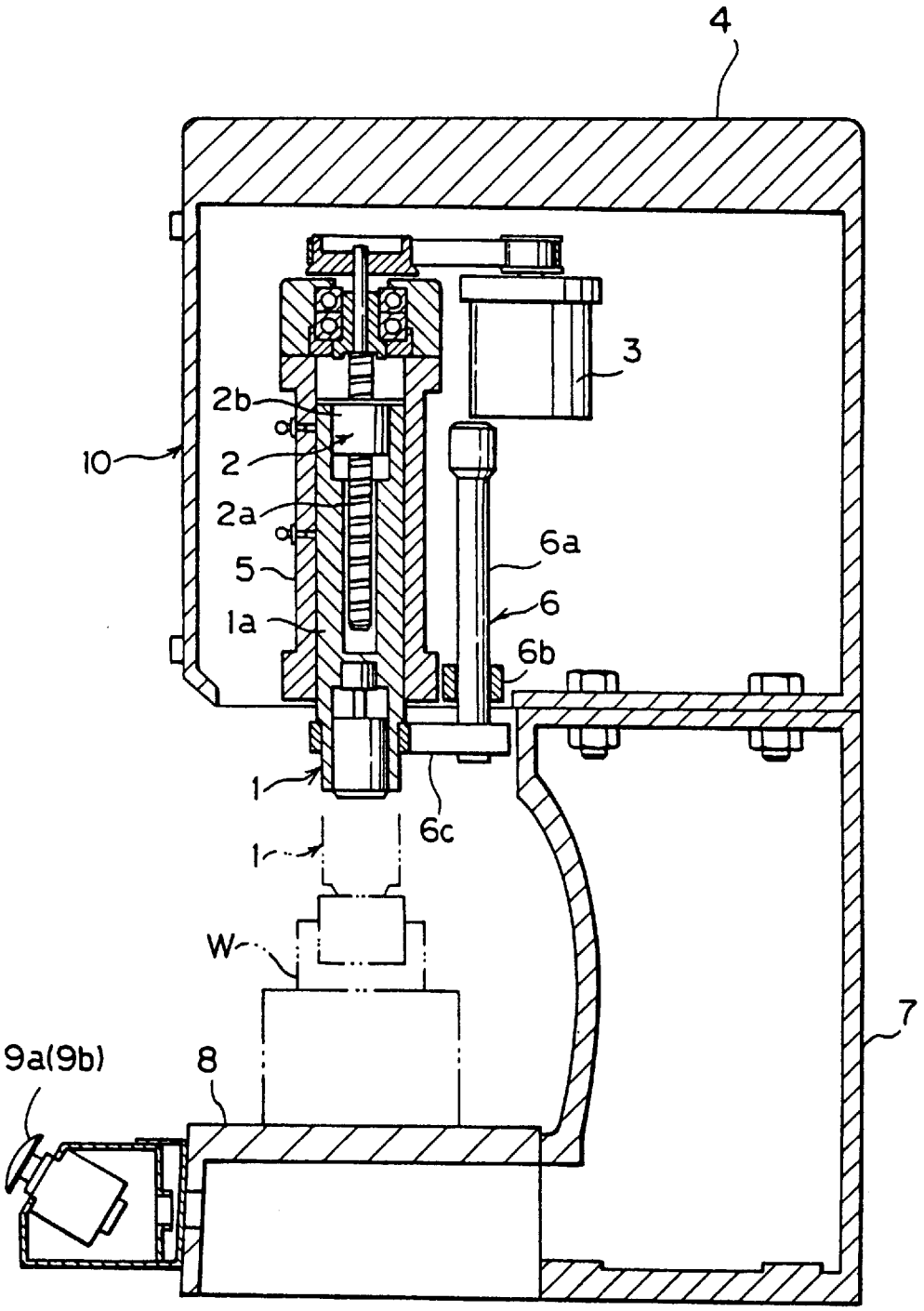
FIG. 7 is a side elevational view of an electropressing apparatus of the invention in vertical section.
Figure 8:
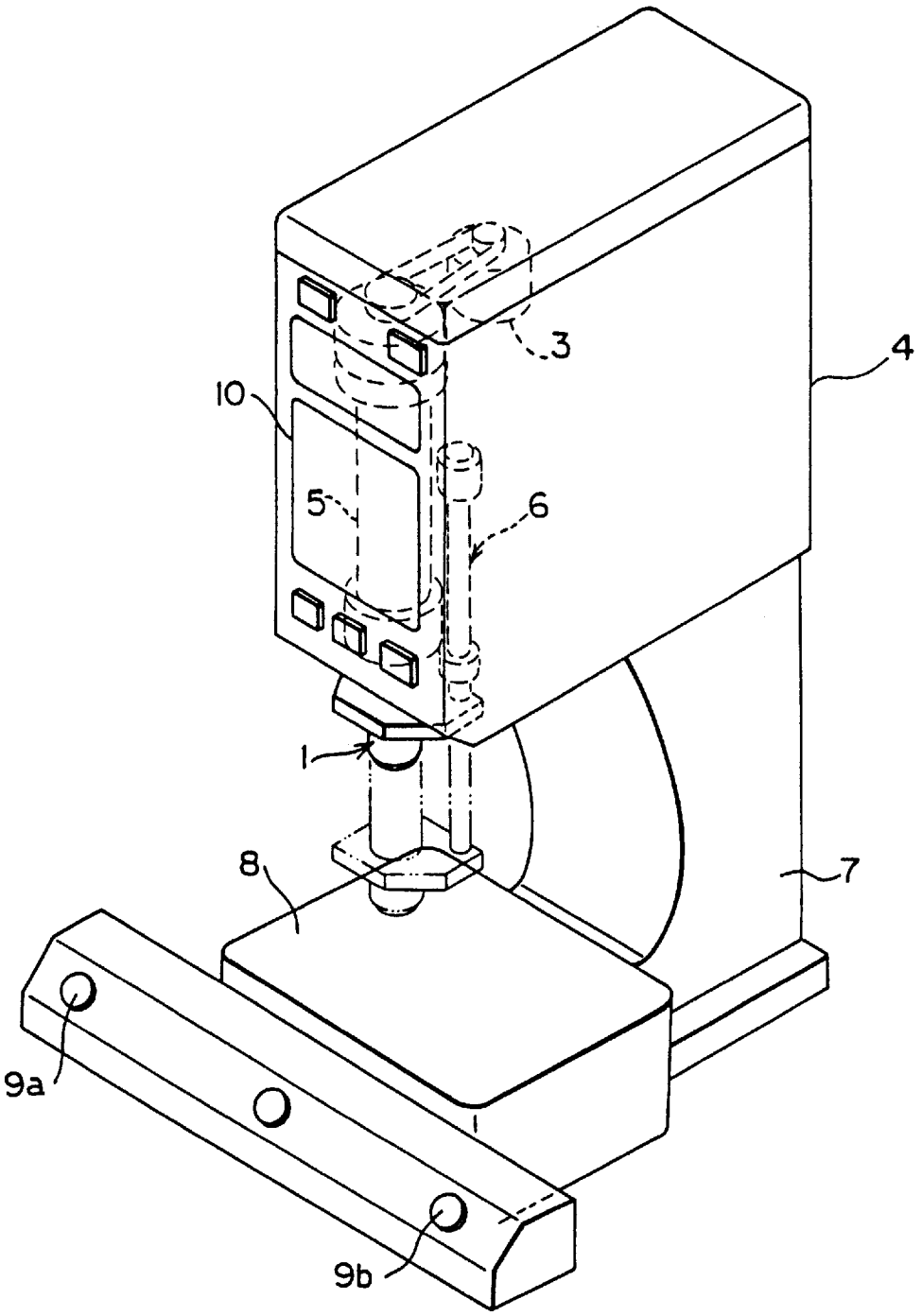
FIG. 8 is a perspective view of the electropressing apparatus.

A preferred embodiment is depicted in FIGS. 7 and 8 wherein an electropressing apparatus of the invention comprises a pressing ram 1 which is vertically movable to import a desired amount of pressure to a workpiece W through a threaded ball-bearing drive shaft 2 which is rotated by an electric drive motor 3 to drive the pressing ram 1 in the vertical directions. The aforementioned components are placed in an upper frame 4 of a casing.

The pressing ram 1 is formed in a ram cylinder 1*a* having a hollow axially extending passage designed to axially receive therein the threaded ball-bearing drive shaft 2 which is composed of a threaded drive shaft 2*a* and a nut block 2*b* in threaded engagement with the shaft 2 through plural ball-bearings (not shown) arranged in fitted engagement with the threads between the threaded drive shaft 2*a* and the nut block 2*b*. The hollow passage is diametrically enlarged at an upper part which receive therein the nut block 2*b* to enable the nut block to be secured to the upper end of the cylinder 1*a*.

The upper end part of the threaded drive shaft 2*a* is journalled in a bearing in the upper frame 4 and operatively connected to the electric drive motor by means of a transmission belt. The rotational movement of the threaded drive shaft 2*a* is transmitted the nut block 2*b* through the ball-bearings. As the result, the nut block is moved axially by the threaded drive shaft 2*a*.

The ram cylinder 1*a* has a press member detachably mounted to the lower end thereof to import a desired amount of pressure to the workpiece W as the cylinder moves vertically downward. The press member my have a strain gauge mounted thereon to detect a pressure imported to the workpiece W.

The ram cylinder 1*a* is received within a cylindrical guide 5 fixedly arranged in the upper frame 4 so that the ram cylinder 1*a* may be vertically slidably moved along an inner peripheral wall of the cylindrical guide 5.

Another guide 6 is mounted adjacent to the cylindrical guide 5 to prevent the ram cylinder 1*a* from rotating in a plane normal to the axis of the ram cylinder 1*a*. The guide 6 includes a vertical guide shaft 6*a* extending parallel with to the cylindrical guide 5. A guide member 6*b* is fixed to the upper frame 4 in sliding engagement with the guide shaft 6*a* to guide the vertical movement of the guide shaft 6*a* as well as a connecting member 6*c* having one end secured to the lower end part of the ram cylinder 1*a* and extending laterally in a plane normal to the axis of the ram cylinder for connection of is other end to the lower end of the guide shaft 6*a*. In this manner, the guide shaft 6*a* vertically moves with the ram cylinder 1*a* while preventing rotation of the ram cylinder within the cylindrical guide 5.

Figure 3:
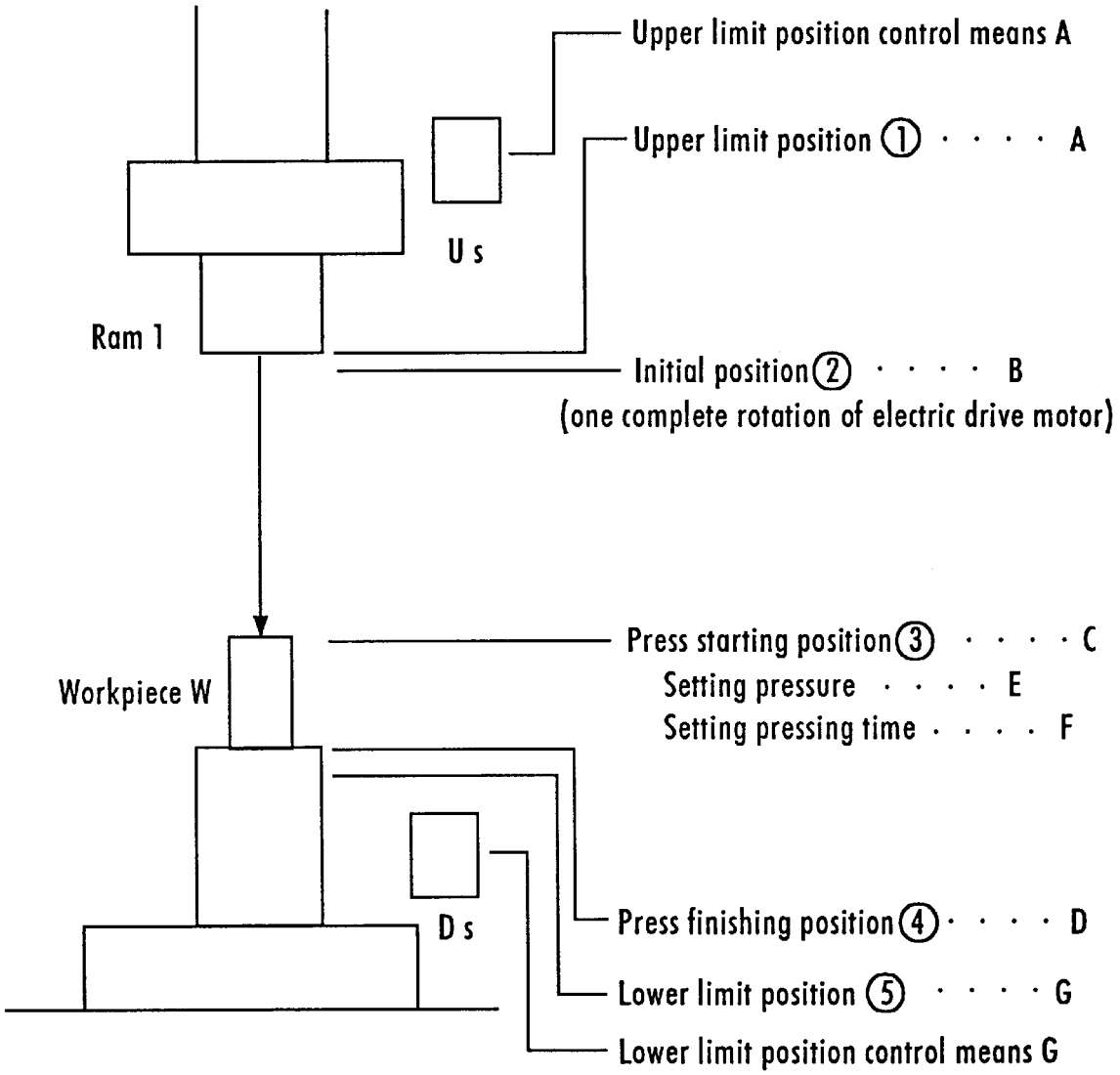
FIG. 3 is an explanatory view showing the positions of a pressing ram to be controlled with reference to a workpiece to be pressed.

With reference to FIGS. 3 and 7, the guide shaft 6*a* has a diametrically enlarged head formed at the upper end thereof. The head is designed to sequentially engage and operate an upper switch Us and a lower switch Ds, as depicted in FIG. 3, during vertical movement of the ram cylinder 1*a* to thereby determine the stroke length of the ram cylinder 1*a* (ie., the limits of upper and lower movement).

Figure 1:
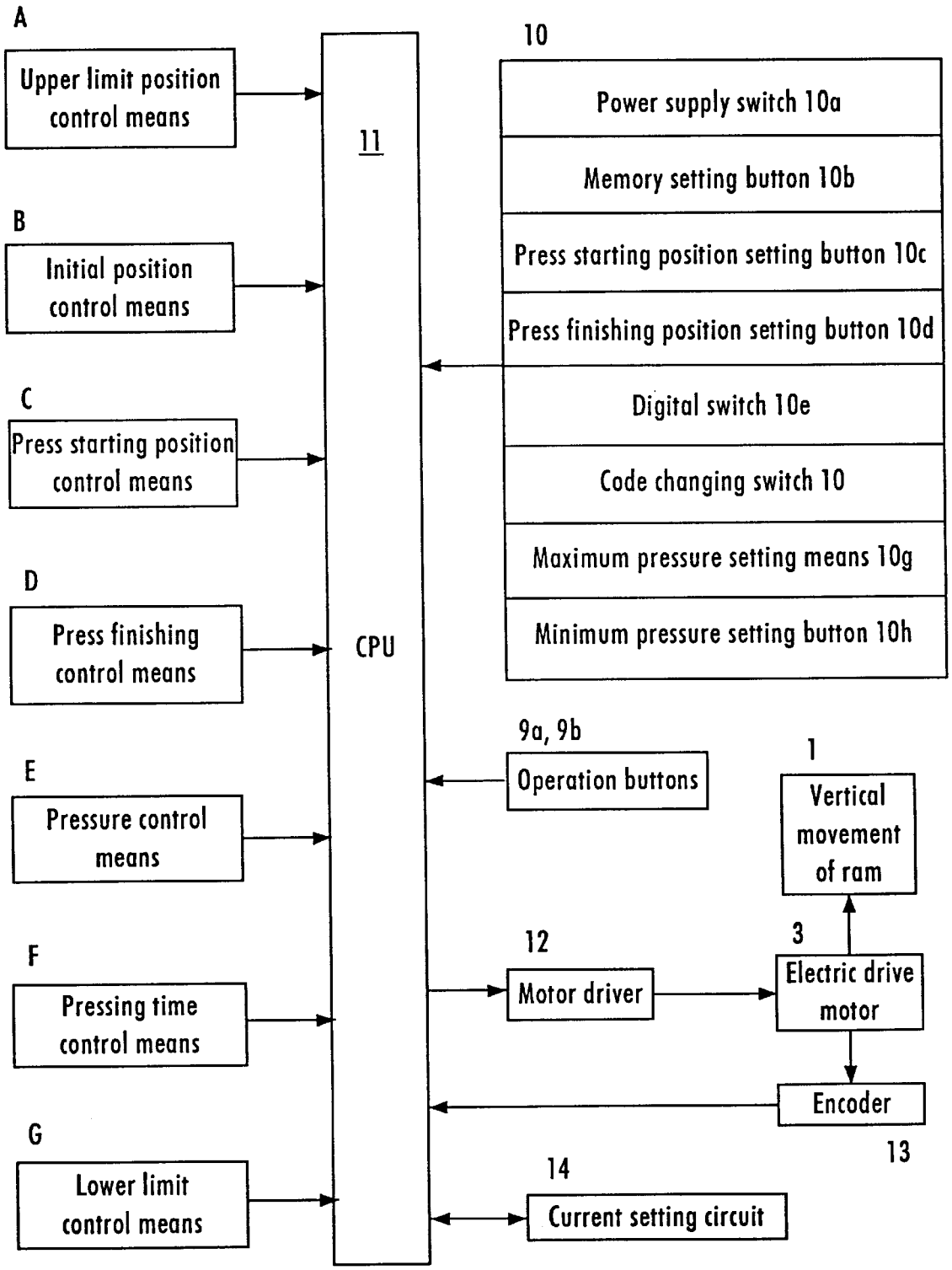
FIG. 1 is a block diagram of a control system according to the invention.

With reference to FIGS. 1, 3 and 7, the upper switch Us produces an operation signal when contacted by the head during upward movement of the guide shaft 6*a*. The operation signal is transmitted to a central processing unit (CPU) 11. The CPU 11 is responsive to the operation signal to signal a motor driver 12 to stop the electric drive motor 3, and thereby prevent further lifting movement of the ram cylinder 1*a,* thus preventing the nut block 2*b* from striking the upper bearing. In a similar manner, the lower switch Ds is operated by the head while the guide shaft 6*a* lowers to produce an operation signal. The CPU 11 is responsive to the operation signal to signal the motor driver 12 to stop the electric drive motor 3, and thereby halt further lowering movement of the ram cylinder 1*a* , preventing the nut block 2*b* from threaded disengagement with the drive shaft 2*a*.

With reference to FIGS. 1, 2 and 3, the upper switch Us is represented as an upper limit control means A for determining the upper limit position① of the lifting movement of the pressing ram 1, and is further represented as comprising a means A2 for detecting a reference position of the pressing ram 1. The lower switch Ds is represented as a lower limit control means G for determining the lower limit position ⑤ of the lowering movement of the pressing ram 1.

With reference to FIGS. 7 and 8, the electropressing apparatus is provided with a lower bed 8 on which the workpiece W is placed below the pressing ram 1. A standard 7 located on one side of the lower bed 8 supports the upper frame 4 at an upper end thereof. The lower bed 8 has a front side part provided with operation buttons 9*a* and 9*b* which are simultaneously pressed to lower the pressing ram 1. The lower movement of the pressing ram 1 is stopped when the button 9*b* is released while the button 9*a* continues to be pressed. The pressing ram 1 is raised when the buttons 9*a* and 9*b* are released at the same time. A control part 10 provided on one side of the upper frame 4 includes a plurality of operation switches and buttons 10*a*–10*h* as shown in FIG. 1.

The switch 10*a* is operated to supply electric power to the electropressing apparatus. The button 10*b* is operated to set various data stored in a memory. The button 10*c* is operated to stop the pressing ram 1 immediately before importing pressure to the workpiece W. The button 10*d* is operated to stop the pressing ram 1 after the pressing ram has imported pressure to the workpiece W. The digital switch 10*e* is used As a code generator for adjusting predetermined stop positions of the pressing ram 1. In practice, the digital switch 10*e* is operated to set an adjusting value and then the code changing switch 10*f* is operated to designate addition or subtraction values. The CPU 11 is then operated to make a calculation for changing the stop position of the pressing ram 1 previously set by the button 10*c*. The button 10*g* is operated to set a maximum pressure to be applied to the workpiece W. The button 10*h* is operated to set a minimum pressure to be applied to the workpiece W.

The CPU 11 stores therein the positions of the pressing ram 1 such as an initial position②, a pressure application position ③, a position at which the speed is changed from high speed to low speed, a position at which a set pressure is generated and each of the predetermined stop positions. The CPU 11 detects when the pressing ram 1 reaches these positions as mentioned above and produces instructions for changing the rotation speed of the electric drive motor 3, the amperage to be supplied to the electric drive motor 3 and for turning on and off power to be supplied to the motor 3 and for reversing the rotation of the motor 3.

The motor driver 12 is operated by the signal of the CPU 11 to drive the electric drive motor 3. As an element for detecting the reference position of the pressing ram 1, an encoder 13 is connected to the electric drive motor 3 to detect a moving amount and the speed of the pressing ram 1.

A current setting circuit 14 is responsive to a digital signal from the CPU 11 to change the digital signal into an analog signal to be supplied to the motor driver 12.

The pressing operation and the setting thereof will be described as follows. When the power switch 10*a* is turned on, the CPU 11 initially signals the motor driver 12 to rotate the electric drive motor 3 to thereby raise the pressing ram 1. As the pressing ram 1 moves up, the head of the guide shaft 6*a* engages the upper switch Us to operate the same. The upper switch Us is then operated to detect the upper limit position ① of the pressing ram 1 and produces an upper limit detecting signal.

The CPU 11 is responsive to the upper limit detecting signal and stops the motor 3 and then reverses the rotation of the motor 3 to move down the pressing ram 1 by a distance corresponding to a number of pulses stored in the CPU 11 while the number of pulses are confirmed by the encoder 13. When the number of pulses are reached, the CPU 11 will stop the motor 3 to thereby determine the initial position ② of the pressing ram 1. In this connection, an initial position control means B comprises means B1 for setting the initial position ② of the pressing ram 1, memory means B2 for storing therein the set initial position ② of the pressing ram 1, detecting means B3 including the encoder 13 for detecting the set initial position and means B4 for changing the set initial position. The pressing ram 1 is operated in reference to the initial position.

Then the operation buttons 9*a* and 9*b* are simultaneously pressed to lower the pressing ram 1. In the meantime, the operation button 9*b* is released while the operation button 9*a* is kept pressed to temporarily stop the pressing ram 1 at a position ③ immediately above the workpiece W at which the pressing ram 1 starts to apply pressure to the workpiece W. Next, the button 10*c* is pressed to memorize the stopped position of the pressing ram 1 within the CPU 11 as a press starting position ③. In this connection, a press starting position control means C comprises means C1 for setting the press starting position ③, means C2 for memorizing therein the set press starting position ③, detecting means C3 for detecting the set press starting position ③ and means C4 for changing the set press starting position ③.

The pressing ram 1 continues to be lowered while the operation buttons 9*a* and 9*b* are simultaneously pressed until the pressing ram reaches a position ④ where the pressing ram 1 has completely pressed the workpiece W and then is stopped. The button 10*d* is then operated to memorize the press finishing position ④ in the CPU 11. In this connection, a press finishing position control means D comprises means D1 for setting the press finishing position ④, means D2 for memorizing therein the set press finishing position ④, means D3 for detecting the set press finishing position and means D4 for changing the set press finishing position.

When the pressing ram 1 reaches the press finishing position ④, the motor 3 is automatically rotated in the opposite direction to raise the pressing ram 1 to the upper initial position ②.

According to the invention, the pressing ram is programmed to descend at a high speed from the initial position ② to the press starting position ③. The pressing ram 1 is programmed to move down at a lower speed with a required level of pressure from the press starting position ③ to the press finishing position ④.

In order to make the press finishing position control means D practically effective, pressure control means E is often employed for controlling a pressure applied to the workpiece W. In this connection, the pressure control means E comprises means El for setting a pressure to be applied to the workpiece W, means E2 for memorizing therein the set pressure, means E3 for detecting the set pressure and means E4 for changing the set pressure.

The press finishing position ④ may be changed as required by setting the digital switch 10*e* with an adjusting value.

A pressing time control means F comprises means F1 for setting a period of time for applying pressure to the workpiece W under the control of the pressure control means E, means F2 for memorizing the set pressing time therein, means F3 for detecting the set pressing time and means F4 for changing the set pressing time. With the conditions being satisfied as mentioned above, the pressing ram 1 will automatically return to the upper initial position ② upon reaching the press finishing position ④. Especially the pressing time starts to be counted at a time when a set pressure is detected.

The CPU 11 is operated under a predetermined program to produce digital instruction signals which are converted into analog current values through the current setting circuit 14 and sent to the motor driver 12 for controlling the operations of the electropressing apparatus.

Figure 4:
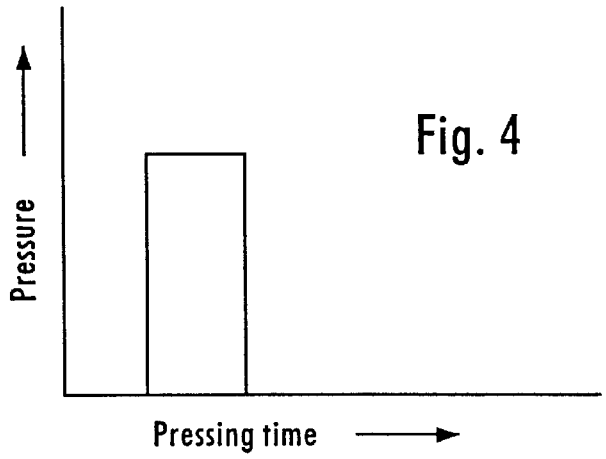
FIG. 4 is a graph showing a relation between a pressure and a pressing time to be applied to a workpiece to be pressed.

FIG. 4 shows a relation between a set pressure and a set pressing time for obtaining a desired pressing result depending on a type of workpiece to be pressed.

Figure 5:
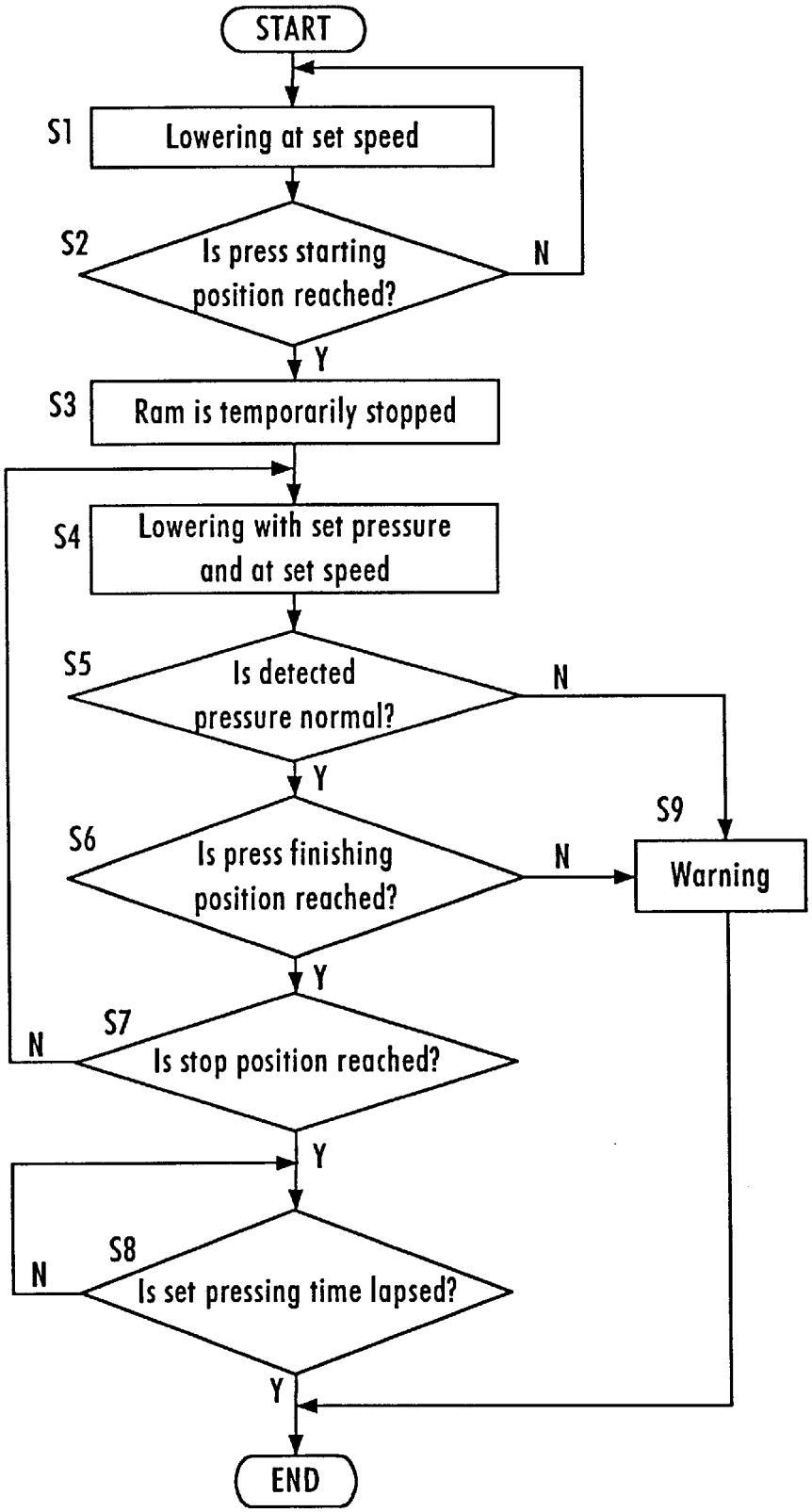
FIG. 5 is a flow chart depicting a series of programmed operations according to the invention.

A flow chart as depicted in FIG. 5 embodying the essential features of work pressing operations according to the invention will now be described:

When the program starts, the pressing ram 1 will be lowered at S1 from the upper initial position ② at a designated high speed.

At S2, the program determines whether the pressing ram 1 has reached a set press starting position ③.

If the discrimination result is Y (Yes), the pressing ram 1 temporarily stops at the set press starting position ③.

At S4, the pressing ram 1 immediately moves down at a speed determined by a minimum amount of current.

At S5, the program determines with a pressure sensor whether the pressure is in a set range.

If the discrimination result is Y, the pressing ram 1 moves down at a designated speed with a designated high pressure.

At S6, the program determines whether the pressing ram 1 has reached the press finishing position ④.

If the discrimination result is Y, the program determines whether the pressing ram 1 has reached a stop position at S7.

If the discrimination result is Y, the pressing ram 1 will stop at the stop position.

At S8, the program determines whether a set pressure has been applied to the workpiece for a set period of time.

If the discrimination result is Y, the pressing ram 1 stops at the stop position.

Thus the sequential steps of pressing operations are finished and then the pressing ram 1 will be automatically returned to the upper initial position ② for the subsequent work pressing operation.

If the discrimination result is N (No) at S5, that is, when the set pressure is not in the set range, a warning is displayed at S9 and the pressing ram 1 is stopped.

If the discrimination result is N at S6, that is, when the pressing ram 1 has not reached the press finishing position ④, the program is returned to S4 for lowering the pressing ram 1 again at a lower speed to be detected with respect to the pressing position ③.

Figure 6:
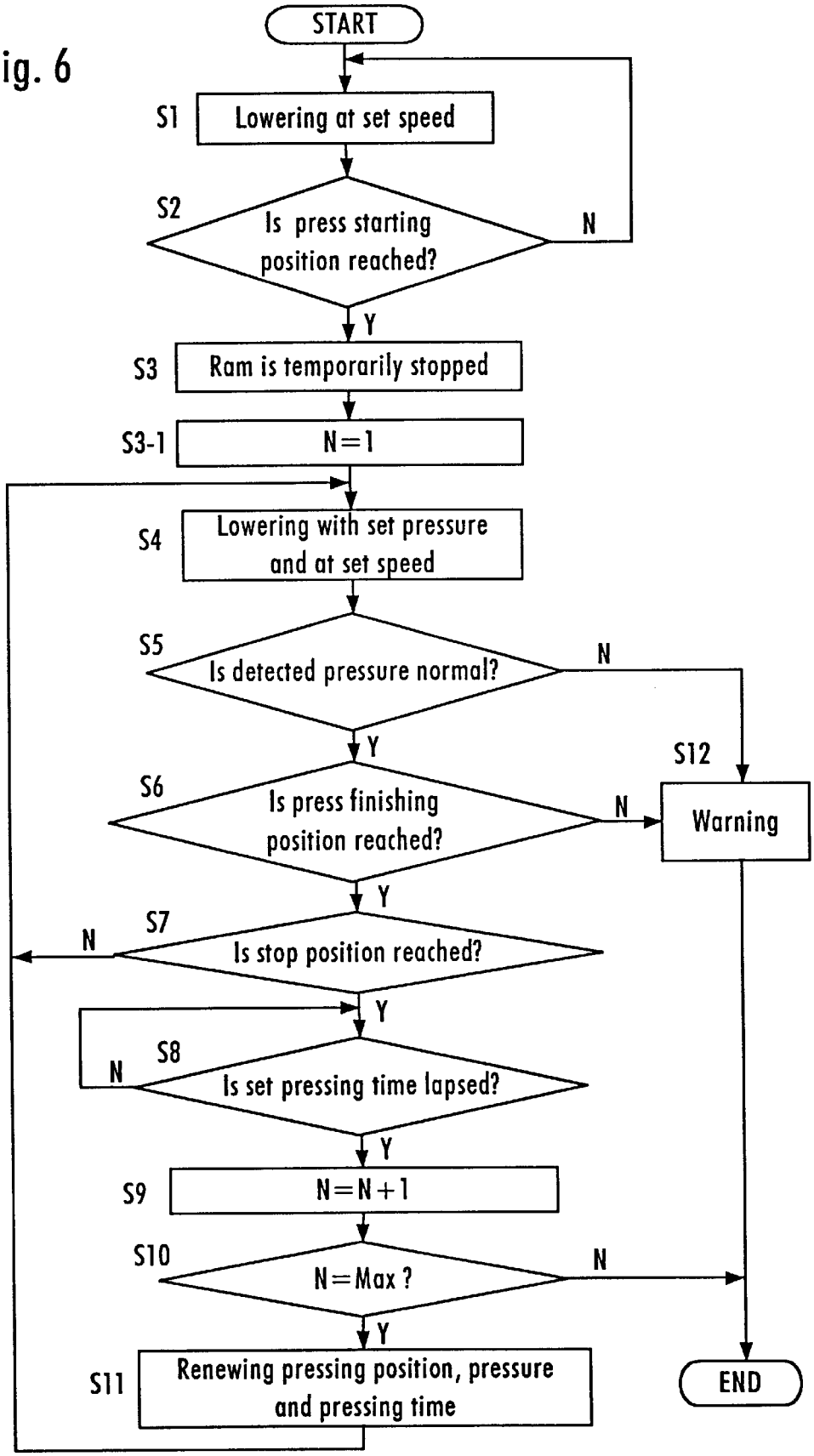
FIG. 6 is another flow chart depicting another series of programmed operations according to the invention.

The flow chart in FIG. 6 depicts a way of programmed operations of the invention slightly different from that of FIG. 5. In FIG. 6, the press starting position, the amount of the pressure applied to the workpiece and the period of time for pressing may be optionally controlled respectively in plural steps, for example, from step N=1 to step N=Max Maximum) by optionally inputting control values depending upon the type of workpiece to be pressed. If M=Max is carried out, the routine is repeated. If N=Max is not carried out, the pressing ram 1 is stopped.

What is claimed is:

1. An electropressing apparatus having a pressing ram axially movable to apply a pressure to a workpiece to be pressed, said apparatus comprising an electric drive motor, a motor driver for driving said electric drive motor, a drive mechanism including a threaded drive shaft operatively connected to said electric drive motor to be rotated by thereby, transmission means operatively connected to said threaded drive shaft and to said pressing ram to convert the rotational movement of said threaded drive shaft into the axial movement of said pressing ram, a first control means for setting, memorizing and detecting an initial position of said pressing ram relative to said workpiece, a second control means for setting, memorizing, detecting and changing a press starting position of said pressing ram relative to said workpiece, a third control means for setting, memorizing, detecting and changing a pressure of said pressing ram to be applied to said workpiece and a fourth control means for setting, memorizing, detecting and changing a period of time of said pressing ram for pressing said workpiece with a set pressure.

2. The apparatus as defined in claim 1, wherein said period of time of said pressing ram for pressing said workpiece with a set pressure starts to be counted at a time when a set pressure is detected.

3. The apparatus as defined in claim 1, wherein said press starting position, said pressure of said pressing ram and said pressing time may be optionally controlled in plural steps respectively by optionally inputting desired control values depending on a type of workpiece to be pressed.

* * * * *